US009545714B2

(12) United States Patent
Lin

(10) Patent No.: US 9,545,714 B2
(45) Date of Patent: Jan. 17, 2017

(54) ROTARY EXTENSION ROD

(71) Applicant: Thomas Lin, Taichung (TW)

(72) Inventor: Thomas Lin, Taichung (TW)

( * ) Notice: Subject to any disclaimer, the term of this patent is extended or adjusted under 35 U.S.C. 154(b) by 201 days.

(21) Appl. No.: 14/463,143

(22) Filed: Aug. 19, 2014

(65) Prior Publication Data

US 2016/0052122 A1 Feb. 25, 2016

(51) Int. Cl.
*B25G 1/04* (2006.01)

(52) U.S. Cl.
CPC ..... *B25G 1/04* (2013.01)

(58) Field of Classification Search
CPC ..... F16B 7/1427; F16B 7/10; F16B 7/14; F16M 11/26; F16M 11/28; F16M 11/32; B25G 1/04; A45B 2009/007; A45B 19/04; Y10T 403/7009; Y10T 403/32501
See application file for complete search history.

(56) References Cited

U.S. PATENT DOCUMENTS 808,992 A * 1/1906 Lawson ..... B25G 3/02 294/57
1,115,057 A * 10/1914 Delaney ..... B65H 75/246 242/575.3
4,782,845 A * 11/1988 Chou ..... A45B 9/00 135/75
5,011,319 A * 4/1991 Levi ..... F16B 7/1427 403/109.5
5,460,458 A * 10/1995 Caceres ..... B25G 1/04 16/429
5,549,407 A * 8/1996 Levi ..... F16B 7/1427 403/109.5
5,692,856 A * 12/1997 Newman, Jr. ..... B25G 1/04 403/109.5
6,619,877 B1 * 9/2003 Huang ..... B25G 1/04 16/429
6,675,674 B2 * 1/2004 Wang ..... F16B 7/1427 16/436
6,866,053 B2 * 3/2005 You ..... A45B 19/04 135/15.1
8,167,616 B2 * 5/2012 Jamnia ..... A61C 3/00 433/143
2002/0096204 A1 * 7/2002 Lin ..... A45B 19/04 135/25.4
2006/0193679 A1 * 8/2006 Lin ..... F16B 7/1427 403/109.5

FOREIGN PATENT DOCUMENTS

CH DE 29620818 U1 * 1/1997 ..... F16B 7/1427
TW GB 2445928 A * 7/2008 ..... B25G 1/04

* cited by examiner

*Primary Examiner* — Daniel Wiley
(74) *Attorney, Agent, or Firm* — Muncy, Geissler, Olds & Lowe, P.C.

(57) ABSTRACT

A rotary extension rod includes an outer tube, an inner tube received in the outer tube, a rotatable assembly having a knob, a fixing seat and a link, and a positioning ring deposited on the fixing seat. The knob is rotatably deposited at one end of the outer tube. The fixing seat is received in the outer tube and fixed to one end of the inner tube. The link is between the knob and the fixing seat, and has two opposite first radially raised portions. The positioning ring has two opposite second radially raised portions. By rotating the knob, the first radially raised portions are posed to abut against or depart from the second radially raised portions, so that the positioning ring radially deforms to press against or release the outer tube, in turn allowing the length of the extension rod to be adjusted.

5 Claims, 7 Drawing Sheets

ROTARY EXTENSION ROD

BACKGROUND OF THE INVENTION

1. Technical Field

The present invention relates to extension rods used with hand tools, and more particularly, to a rotary extension rod.

2. Description of Related Art

For providing various levels of reach and convenient use, many hand tools (such as garden shears) are designed to work with an extension rod so as to be adjustable in length. For example, one prior-art patent owned by the applicant, Taiwan Patent No. M268476, has disclosed an extension rod that uses a knob to control a rotatory member to deflect. When the major-radius portions of the rotatory member press against the inner wall of the positioning ring, the rubber part of the positioning ring abuts against the inner wall of the outer tube and prevents the outer tube from moving with respect to the inner tube, thereby providing positioning effect. When the major-radius portions of rotatory member separate from the inner wall of the positioning ring, the rubber part of the positioning ring leaves from the inner wall of the outer tube, thereby allowing the outer tube to be repositioned as desired.

However, in practical use, the major-radius portions of the rotatory member and the inner wall of the positioning ring hardly contact with each other as expected. As a result, the positioning ring is not effectively opened wide by the rotatory member and the friction to the outer tube is therefore impaired. Consequently, when the outer tube receives a relatively large axial force, the tubes tend to slide and the total length of the inner and outer tubes of the known extension rod is likely to unexpectedly change in use. Hence, the prior art needs to be improved.

SUMMARY OF THE INVENTION

The primary objective of the present invention is to provide a rotary extension rod that is configured to secure the relative position of its inner and outer tubes, and thereby its overall length, as adjusted.

For achieving the foregoing objective, the disclosed rotary extension rod comprises an outer tube, an inner tube, a rotatable assembly, and a positioning ring. The inner tube has one end passing through the outer tube in an axially movable manner. The rotatable assembly includes a knob, a fixing seat, and a link. The knob is rotatably deposited at one end of the outer tube. The fixing seat is received in the outer tube and fixed to one end of the inner tube. The fixing seat has an axial hole for the link to extend therethrough and two axial rods defining a hollow-out portion communicated with the axial hole. The link has one end fixed to the knob and an opposite end rotatably received in the fixing seat and located between the two axial rods, so that the link can be driven by the knob. The outer periphery of the link is provided with two opposite first radially raised portions. The positioning ring is mounted on the fixing seat and has the link passing therethrough. The inner annular surface of the positioning ring is provided with two opposite second radially raised portions. The positioning ring has a C-shaped sectional profile and is adapted to clamp the two axial rods of the fixing seat therein.

Thereby, when the knob is at the locking position, the first radially raised portions of the link abut against the second radially raised portions of the positioning ring, so that the outer annular surface of the positioning ring presses against the inner wall of the outer tube. At this time, the inner and outer tubes are relatively positioned. When the knob is at the releasing position, the first radially raised portions of the link depart from the second radially raised portions of the positioning ring, so that the outer annular surface of the positioning ring separates from the inner wall of the outer tube, thereby allowing the relative position of the inner and outer tubes, or the overall length of the extension rod, to be adjusted.

DETAILED DESCRIPTION OF THE INVENTION

Figure 1:
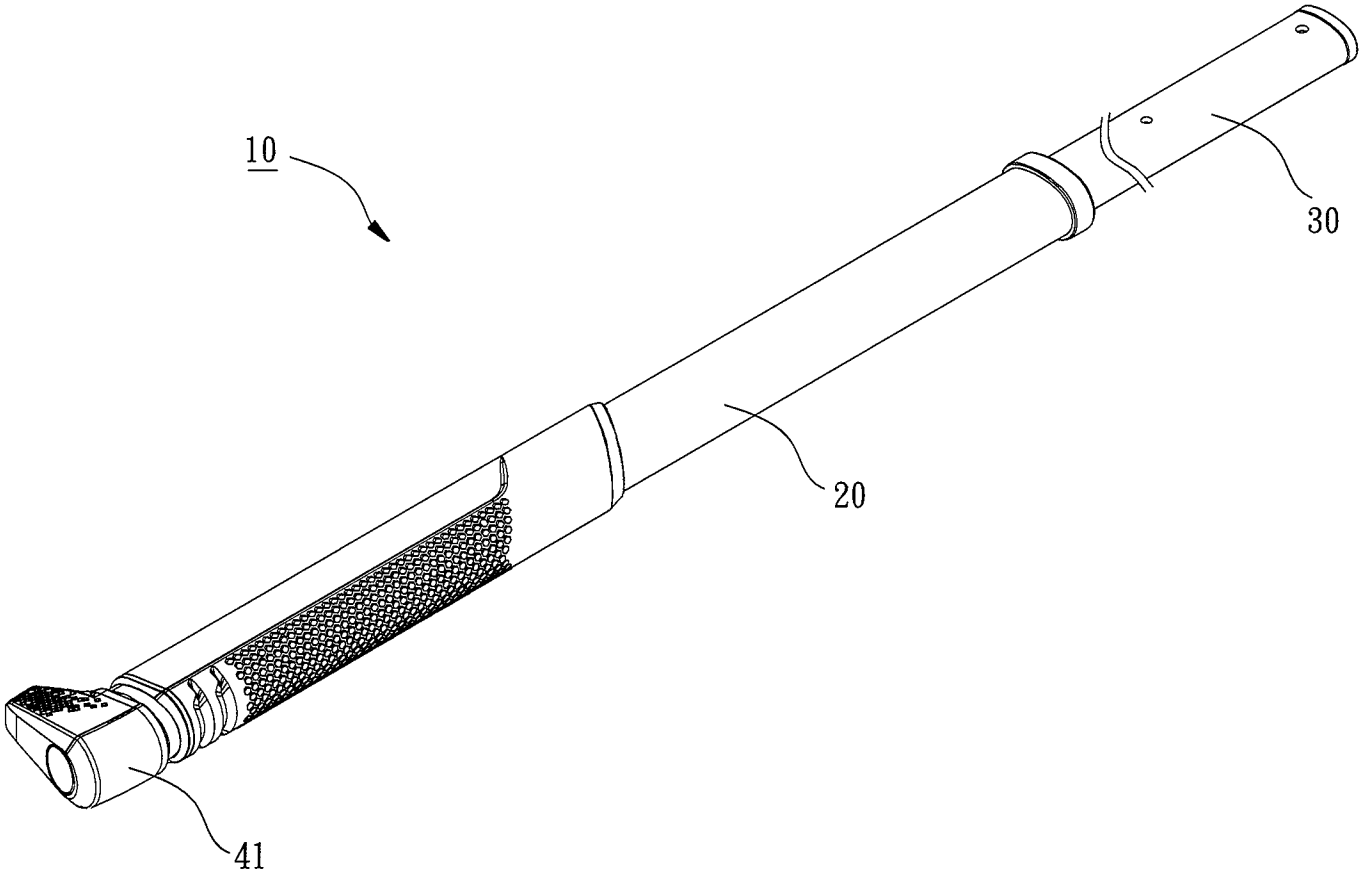
FIG. 1 is a perspective view of a first embodiment of the present invention.
Figure 2:
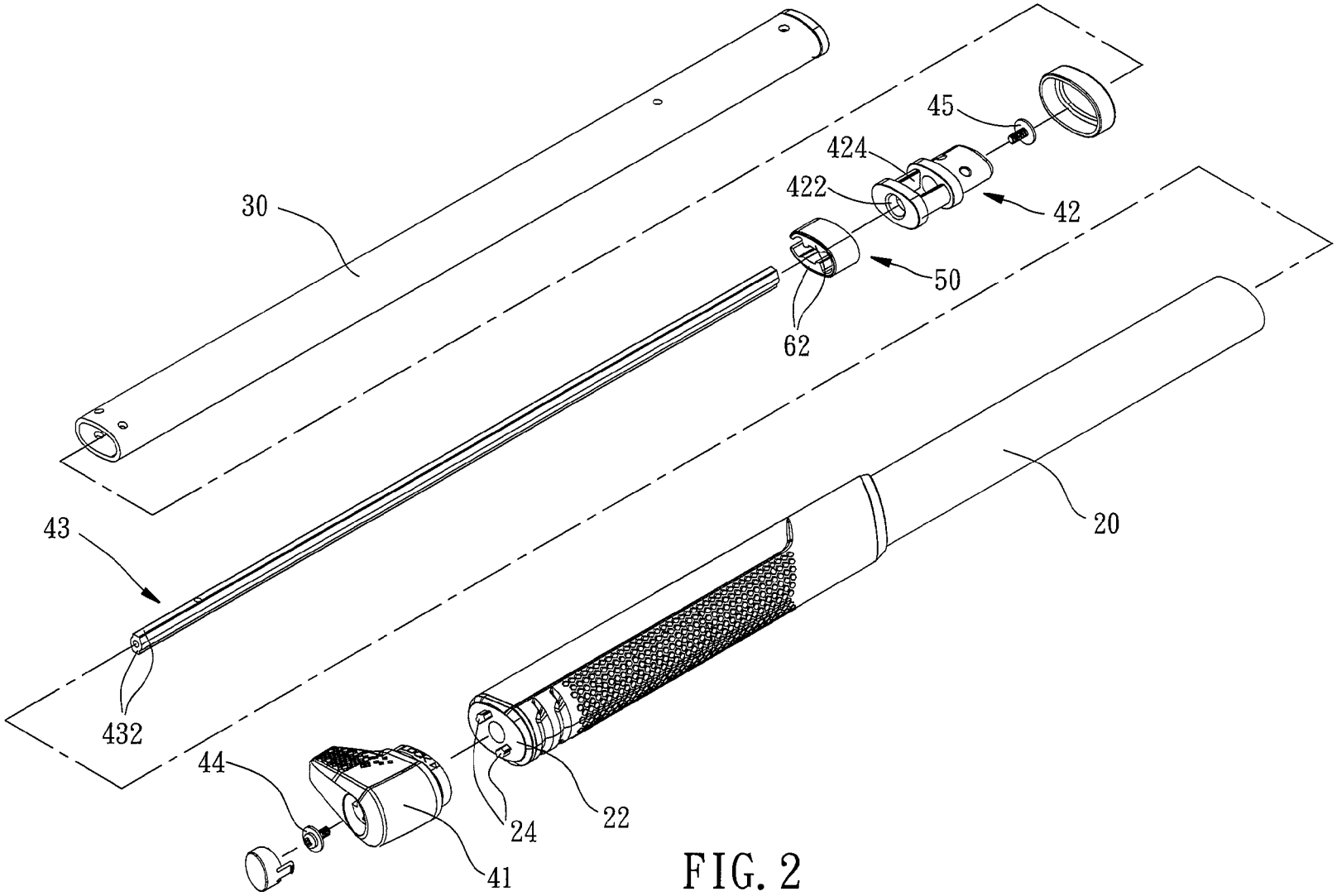
FIG. 2 is an exploded view of the first embodiment of the present invention.

Referring to FIG. 1 and FIG. 2, according to the present invention, an extension rod 10 is designed to work with a hand tool (such as garden shears), and structurally comprises an outer tube 20, an inner tube 30, a rotatable assembly 40, and a positioning ring 50.

The outer tube 20 may have an elliptic sectional shape. The outer tube 20 has one end covered by an end cap 22. The end cap 22 has its outer end formed with two opposite guiding blocks 24. Each of the guiding blocks 24 has a positioning node 26 formed on its outer periphery.

The inner tube 30 may also have an elliptic sectional shape. The inner tube 30 is inserted into the outer tube 20 from an opposite end of the outer tube 20, and can move with respect to the outer tube 20 under an external force.

Figure 3:
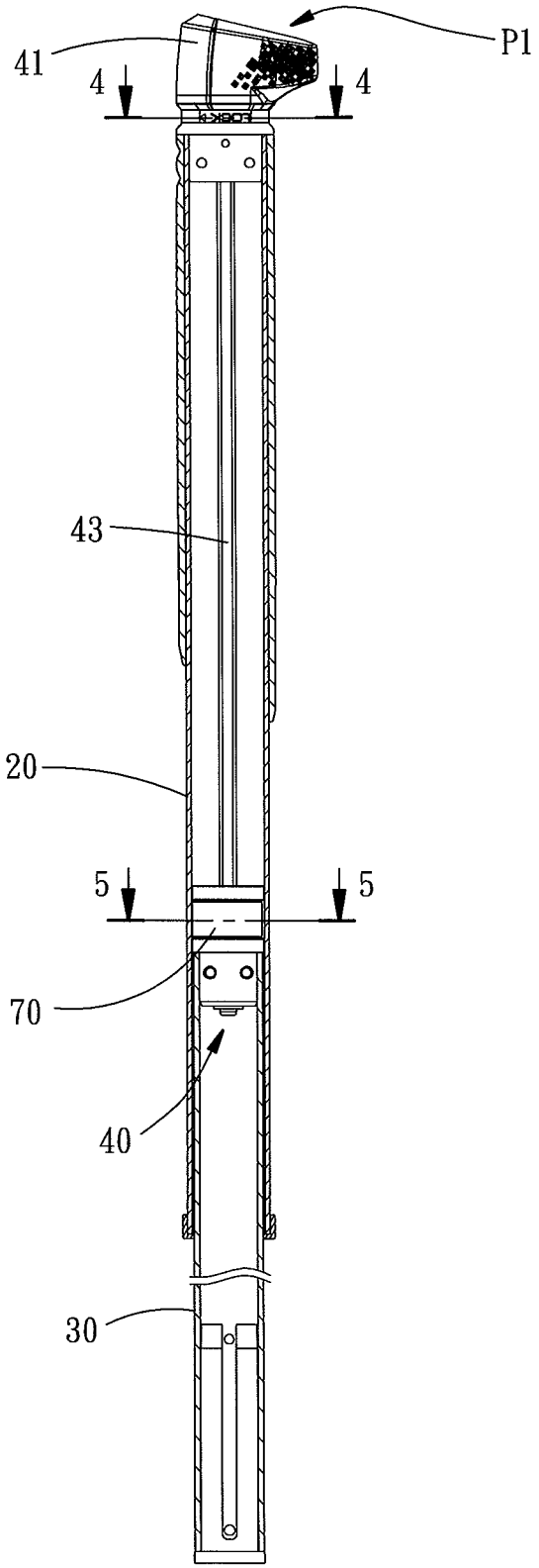
FIG. 3 is a lengthwise cross-sectional view of the first embodiment of the present invention, showing the knob at its locking position.
Figure 4:
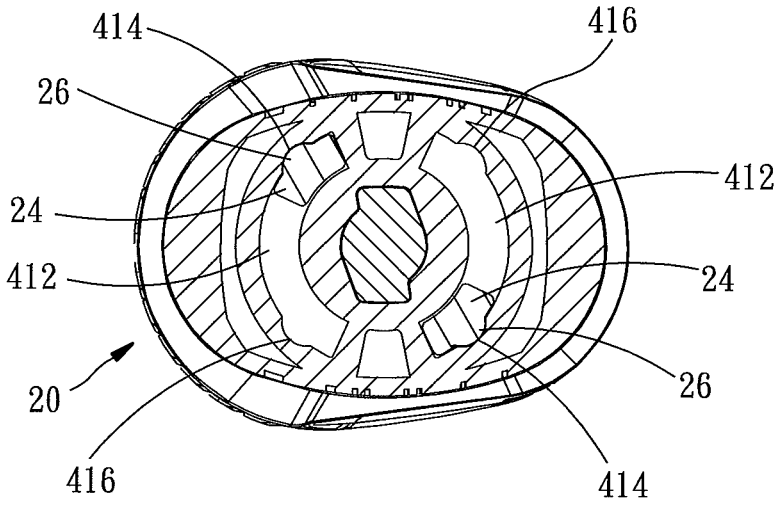
FIG. 4 is a cross-sectional view taken along Line 4-4 of FIG. 3.
Figure 6:
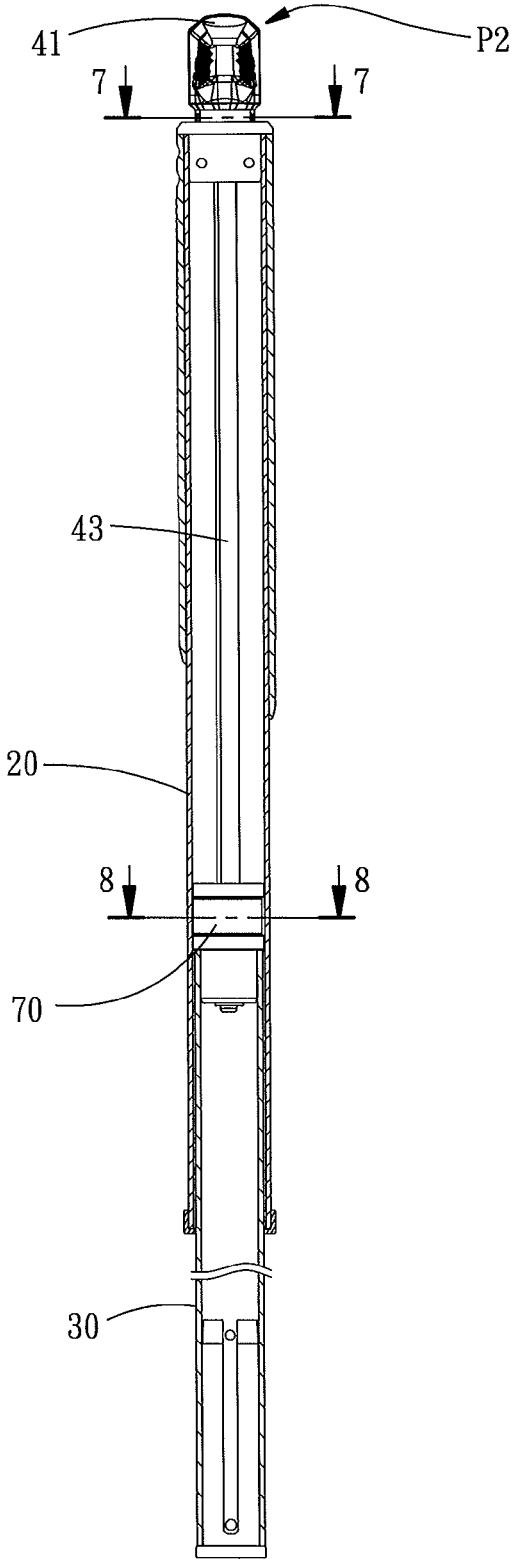
FIG. 6, similar to FIG. 3, shows the knob at its releasing position.
Figure 7:
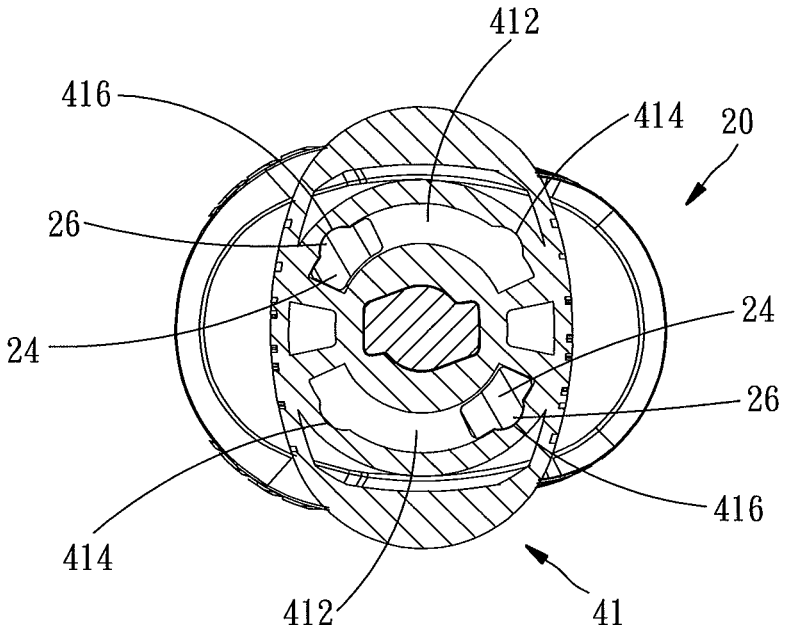
FIG. 7 is a cross-sectional view taken along Line 7-7 of FIG. 6.

The rotatable assembly 40 includes a knob 41. The knob 41 has its inner end surface formed with two opposite curved channels 412, as shown in FIG. 4 and FIG. 7. Each of the curved channels 412 has two ends that are provided with a first positioning indentation 414 and a second positioning indentation 416, respectively. To assemble the components, the curved channel 412 engages with the guiding blocks 24 on the end cap 22 of the outer tube 20, so that the knob 41 can move with respect to the outer tube 20 between a locking position P1 and a releasing position P2. When the knob 41 is at the locking position P1, as shown in FIG. 3 and FIG. 4, the first positioning indentation 414 of curved channel 412 of the knob 41 engages with the positioning node 26 of the end cap 22 of the outer tube 20. When the knob 41 is at the releasing position P2, as shown in FIG. 6 and FIG. 7, the second positioning indentation 416 of the curved channel 412 of the knob 41 engages with the positioning node 26 of the end cap 22 of the outer tube 20. In addition, the rotatable assembly 40 further has a fixing seat 42 and a link 43. The fixing seat 42 is set in the outer tube 20 and fixed to one end of the inner tube 30, while having an axial hole 422 and two axial rods defining a hollowed-out portion 424 communicated with the axial hole 422. The link 43 has its outer periphery formed with two opposite first radially raised portions 432. The link 43 is inserted into the outer tube 20 and has one end fixed to the knob 41 by a screw 44, so that the link 43 can be synchronously driven by the knob 41. The link 43 has its opposite end rotatably passing through the axial hole 422 of the fixing seat 42, and another screw 45 is used to secure the combination between the link 43 and the fixing seat 42, so that the fixing seat 42 does not rotate with the link 43.

Figure 5:
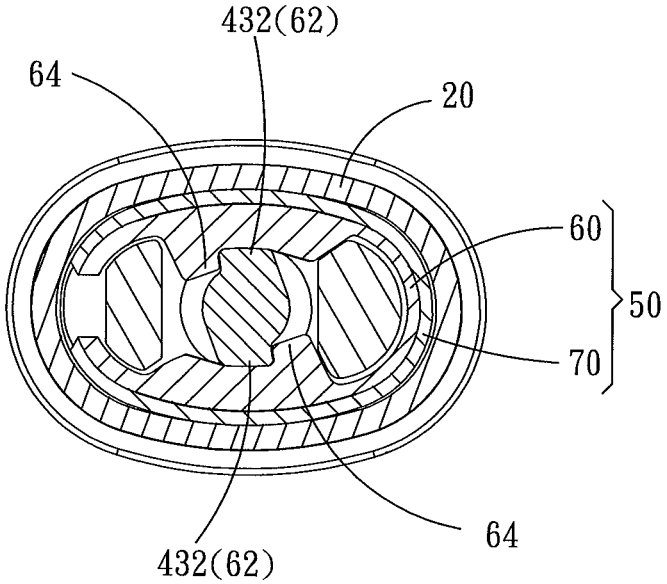
FIG. 5 is a cross-sectional view taken along Line 5-5 of FIG. 3.
Figure 8:
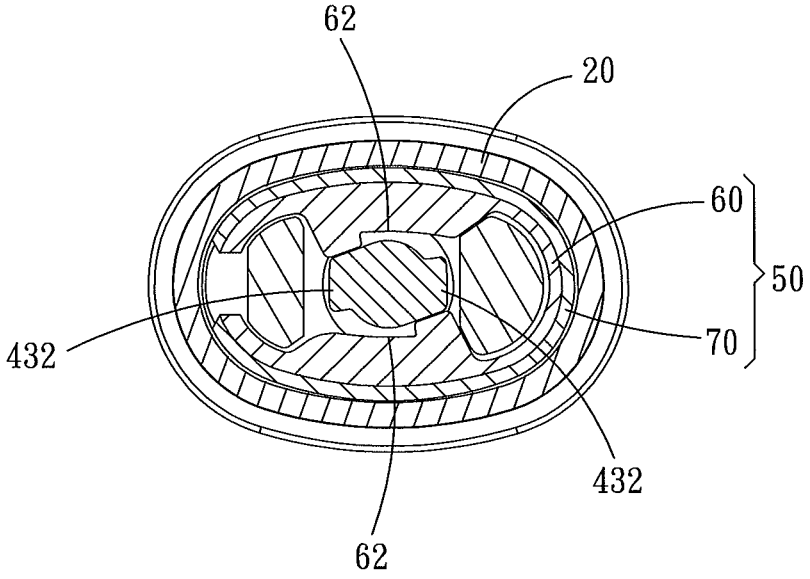
FIG. 8 is a cross-sectional view taken along Line 8-8 of FIG. 6.

The positioning ring 50 has a C-like sectional shape and includes a supporting member 60 and a friction member 70, as shown in FIG. 5 and FIG. 8. The supporting member 60 has two opposite second radially raised portions 62 on its inner annular surface. Each of the second radially raised portions 62 is next to a retaining portion 64. The friction member 70 stays close to the outer annular surface of the supporting member 60, for providing friction to the inner wall of the outer tube 20. The positioning ring 50 is mounted around the fixing seat 42, so that the second radially raised portions 62 and the retaining portions 64 of the supporting member 60 of the positioning ring 50 are inlaid in the hollowed-out portion 424 of the fixing seat 42 (as shown in FIG. 2). It is to be noted that the supporting member 60 is preferably made of a rigid material, such as metal, fiber-reinforced plastic and hardened plastic. The friction member 70 is preferably made of a soft material with high friction coefficient, such as plastic and rubber. The components may be combined by gluing or overmolding.

For adjusting the relative position of the outer tube 20 and the inner tube 30, the knob 41 is first rotated to the releasing position P2 as shown in FIG. 6. At this time, the knob 41 drives the link 43 to rotate with respect to the positioning ring 50, making the first radially raised portions 432 of the link 43 leaving from the second radially raised portions 62 of the supporting member 60 of the positioning ring 50, as shown in FIG. 8. Thereby, the outer annular surface of the friction member 70 of the positioning ring 50 release the inner wall of the outer tube 20 from press, so the outer tube 20 can be moved with respect to the inner tube 30 to change the overall length of the extension rod.

When the outer tube 20 is positioned as desired, the knob 41 is rotated to the locking position P1 as shown in FIG. 3, where the first radially raised portions 432 of the link 43 press against the second radially raised portions 62 of the supporting member 60 of the positioning ring 50, and the first radially raised portions 432 of the link 43 abut against the retaining portions 64 of the supporting member 60 of the positioning ring 50. At this time, the positioning ring 50 is radially expanded, with the outer annular surface of the friction member 70 pressing against the inner wall of the outer tube 20, thereby holding the outer tube 20 in position.

Figure 9:
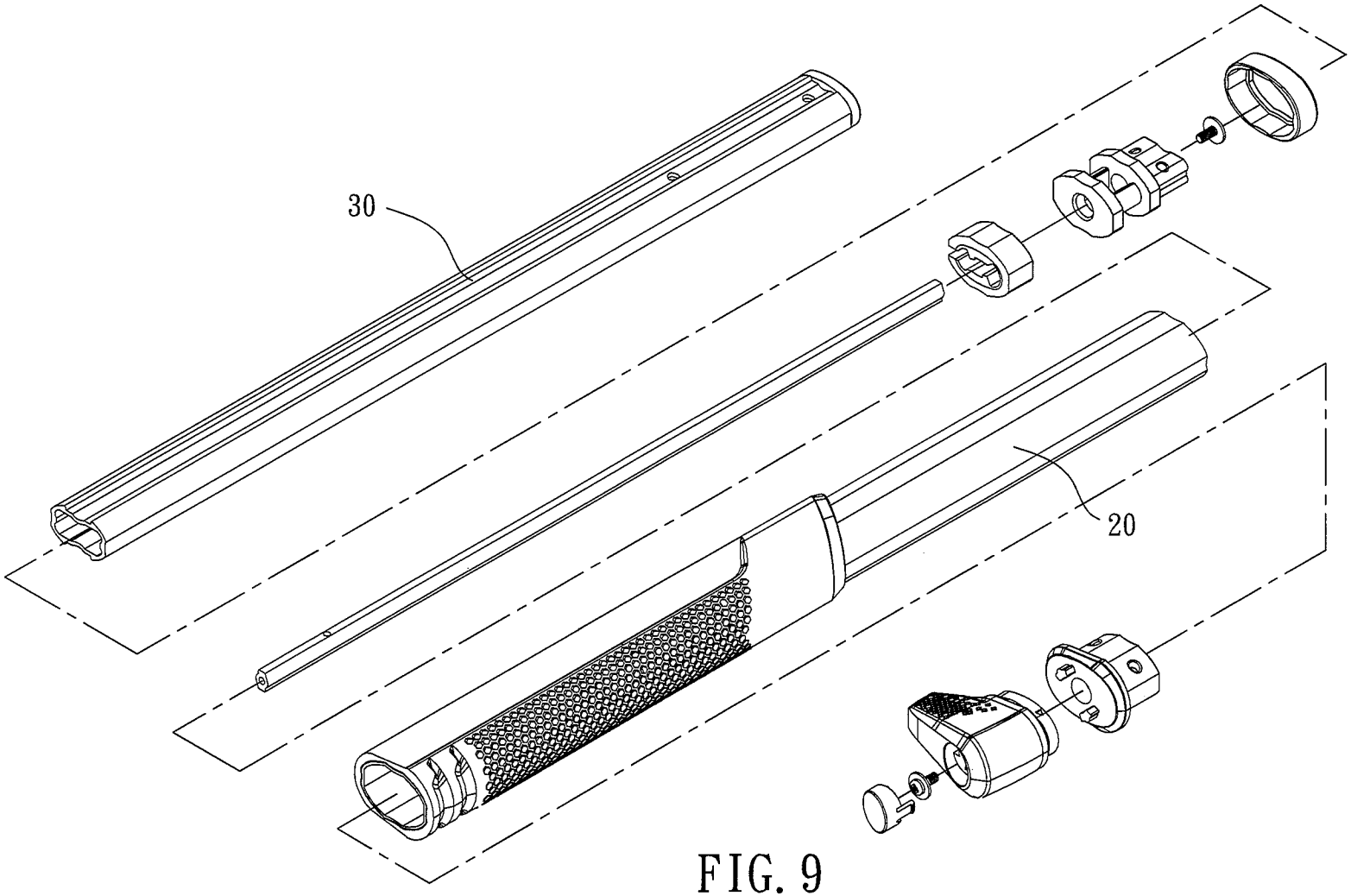
FIG. 9 is an exploded view of a second embodiment of the present invention.

To sum up, with the cooperation between the first radially raised portions 432 of the link 43 and the second radially raised portions 62 of the positioning ring 50, the contact between the link 43 and the positioning ring 50 is significantly improved, so that the positioning ring 50 and the outer tube 20 can be well positioned with respect to each other, in turn maintaining the relative position of the adjusted inner and outer tubes 30, 20. At last, it is to be noted that the outer tube 20 and the inner tube 30 may have the same sectional shape that is not elliptic (such as the polygonal shape as shown in FIG. 9), so as to provide enhanced structural strength.

What is claimed is:

1. A rotary extension rod, comprising:

an outer tube;

an inner tube, received in the outer tube in an axially movable manner;

a rotatable assembly, having a knob, a fixing seat, and a link; the knob being deposited at one end of the outer tube and rotatable between a locking position and a releasing position; the fixing seat being received in the outer tube and fixed to one end of the inner tube, the fixing seat having an axial hole for the link to extend therethrough and two axial rods defining a hollowed-out portion communicated with the axial hole; and the link having one end fixed to the knob and an opposite end rotatably received in the fixing seat and located between the two axial rods, and including two opposite first radially raised portions formed on an outer periphery thereof; and a positioning ring, being mounted around the fixing seat and having the link passing therethrough, and the positioning ring further having two opposite second radially raised portions formed on an inner annular surface thereof, the positioning ring having a C-shaped sectional profile and being adapted to clamp the two axial rods of the fixing seat therein;

wherein, when the knob is at the locking position, the first radially raised portions of the link abut against the second radially raised portions of the positioning ring, so that an outer annular surface of the positioning ring presses against an inner wall of the outer tube, and when the knob is at the releasing position, the first radially raised portions of the link depart from the second radially raised portions of the positioning ring, so as to make the outer annular surface of the positioning ring separate from the inner wall of the outer tube.

2. The rotary extension rod of claim 1, wherein the inner annular surface of the positioning ring further has two opposite retaining portions, in which each said retaining portion is next to one said second radially raised portion, so that when the knob is at the locking position, the first radially raised portions of the link abut against the retaining portions of the positioning ring.

3. The rotary extension rod of claim 1, wherein the positioning ring has a supporting member and a friction member, in which the supporting member has the second radially raised portions formed on an inner annular surface thereof, and the friction member is formed on an outer annular surface of the supporting member.

4. The rotary extension rod of claim 3, wherein the inner annular surface of the supporting member of the positioning ring further has two opposite retaining portions, in which each said retaining portion is next to one said second radially raised portion, so that when the knob is at the locking position, the first radially raised portions of the link abut against the retaining portions of the supporting member of the positioning ring.

5. The rotary extension rod of claim 1, wherein an end cap is provided at one end of the outer tube, and the end cap has an outer end surface provided with a guiding block, the guiding block having a positioning node formed on an outer periphery thereof, the knob having a curved channel formed on an inner end surface thereof, the curved channel receiving the guiding block of the end cap, and the curved channel having two ends thereof provided with a first positioning indentation and a second positioning indentation, respectively, so that when the knob is at the locking position, the first positioning indentation of the channel of the knob engages with the positioning node of the end cap of the outer tube, and when the knob is at the releasing position, the second positioning indentation of the channel of the knob engages with the positioning node of the end cap of the outer tube.

* * * * *